United States Patent [19]

Turek

[11] 4,013,369

[45] Mar. 22, 1977

[54] SPRAYER-WIPER DEVICE

[76] Inventor: Alice Turek, 1715 Illinois Road, Northbrook, Ill. 60062

[22] Filed: Nov. 7, 1975

[21] Appl. No.: 630,040

[52] U.S. Cl. ..... 401/139; 401/190

[51] Int. Cl.[2] ..... A47L 13/26

[58] Field of Search ..... 401/150, 190, 137–139; 222/174

[56] References Cited

UNITED STATES PATENTS

| | | | |
|---|---|---|---|
| 2,787,501 | 4/1957 | Tuma | 222/174 |
| 3,008,164 | 11/1961 | Herman et al. | 401/139 X |
| 3,185,351 | 5/1965 | Klun | 401/139 X |
| 3,679,319 | 7/1972 | Munchel et al. | 401/138 |
| 3,722,021 | 3/1973 | Brainerd et al. | 401/90 X |

*Primary Examiner*—Stanley H. Tollberg
*Assistant Examiner*—Norman L. Stack, Jr.
*Attorney, Agent, or Firm*—Merriam, Marshall, Shapiro & Klose

[57] ABSTRACT

A sprayer-wiper device including a container having a fluid dispensing means with a releasable wiper head having wiper pads thereon spaced from said dispensing means.

5 Claims, 4 Drawing Figures

SPRAYER-WIPER DEVICE

BACKGROUND OF THE INVENTION

This invention relates to a new and improved combination spray-wiper device and more particularly to a device which, subsequent to spraying or atomizing an object to be cleaned, wipes and cleans the object with a wiper pad located on the head of the device whereby undesired materials are removed from the object onto the wiper pad.

In cleaning a window, mirror or other object, it is desired to have a device which can dispense a fluid onto an object to be cleaned, after which the fluid and dirt or other particles to be removed are wiped clean by a wiper member which is an integral part of the device. Preferably the device should be lightweight so it can be held in one hand and the fluid dispensing means and wiper member oriented relative to each other so that the device need not be turned or rotated in the course of a spraying and wiping operation.

Unfortunately, devices presently available to accomplish these objectives are unsatisfactory. One prior art device is disclosed in U.S. Pat. No. 2,787,501. However, this device suffers from the disadvantage of being too cumbersome in that an oscillating lever means is utilized with the unit. Additionally, the unit must be rotated 180° between a spraying and cleaning operation. Further, the device requires a relatively large number of parts.

What is desired is a fluid dispensing and wiper device in which the dispensing means are readily fastened to the fluid container and the wiper means is adapted to be readily connected to the fluid dispensing means and container. Moreover, the device should comprise relatively few parts which can be readily assembled or disassembled.

SUMMARY OF THE INVENTION

With the view of overcoming the various problems associated with the prior art sprayer-wiper devices, the invention herein disclosed and claimed relates to a device which includes a container adapted to receive a fluid for use in a cleaning operation. A fluid dispensing means such as a reciprocating spray means or atomizing unit is threaded onto the container.

Disposed above and spaced from the fluid dispensing means is a wiper pad member. This member preferably is releasably connected to the base of a bracket. The bracket includes spaced, biased leg members. The free, outboard end of each leg has a lug portion which is adapted to seat in a recess formed by the junction of the container and fluid dispensing means. The spaced legs are normally biased toward one another; however, in assembly, the legs are pulled outward away from each other and positioned over the dispensing means with the lugs being inserted in the recess formed by the container and dispensing means. The legs, upon their release, will spring inwardly until they contact the dispensing means, whereby the wiper head is maintained in a spaced position above the dispensing means.

In the event fluid is to be replenished in the container, the bracket legs are urged outwardly to remove the lugs from the recess and the bracket and wiper head are removed from the dispensing means so that fluid can be replenished after the fluid dispensing means is disconnected from the container.

If a wiper head need be replaced, the head can be disconnected from the bracket and a new wiper head inserted. In another embodiment of the invention, the wiper head includes means whereby the entire head need not be replaced but instead the wiper head incorporates a replaceable pad means.

The combination of the fluid dispensing-wiper device of the present invention provides a unit having relatively few parts which can be readily assembled. The device is relatively lightweight so it can be easily held and operated in one hand. The wiper unit is spaced sufficiently far away from the dispensing means so that one or more of an operator's fingers can freely activate the fluid dispensing means.

The wiper head is positioned above the fluid dispensing unit so that the wiper pad can wipe the surface that has been sprayed with fluid from the container. Preferably, the wiper head has a wiper pad located on the same side as the exit port on the fluid dispensing means.

In operation, fluid can be sprayed onto the object to be cleaned and the wiper pad can immediately follow the fluid dispensing operation without rotation or turning of the device. If desired, additional wiper pads can be incorporated on the wiper head. After one pad has been used, the wiper head can be rotated to position another wiper pad in a spaced position above the fluid exit port. A further embodiment includes the utilization of replaceable wiper pads whereby the pads on the wiper head can be replaced without replacing the entire wiping head unit.

DESCRIPTION OF THE DRAWINGS

The invention will be better understood from the following detailed description thereof, taken in conjunction with the accompanying drawings, wherein.

DETAILED DESCRIPTION

Figure 1:
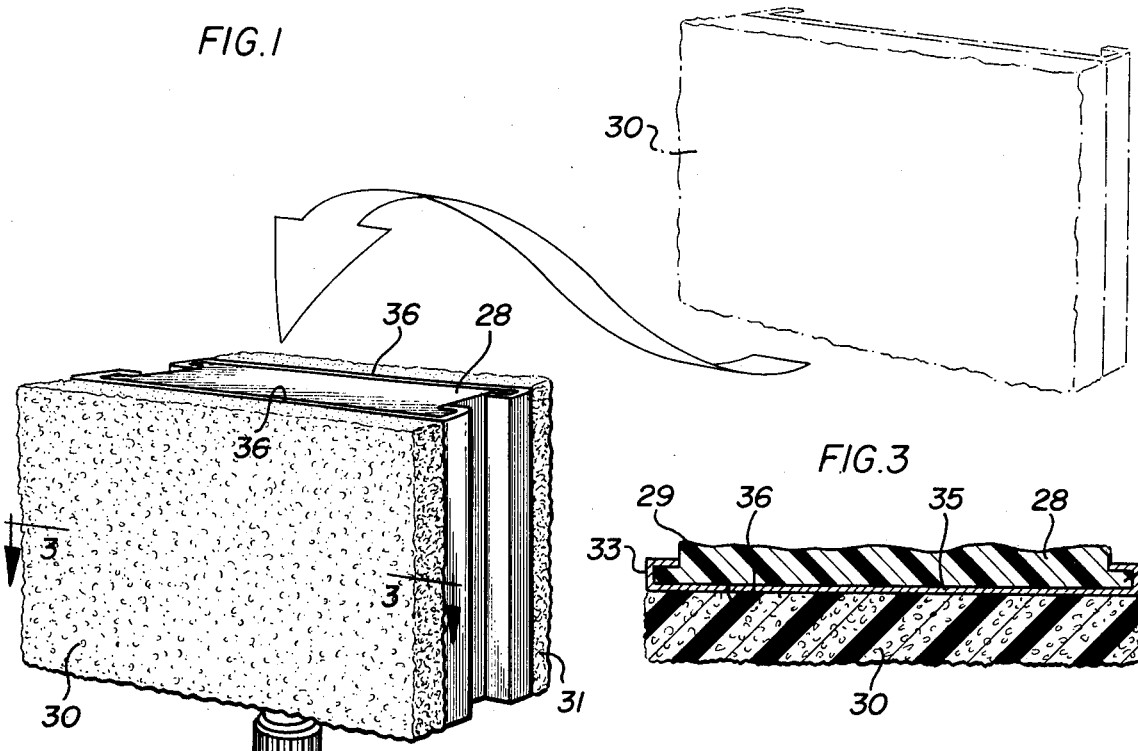
FIG. 1 shows a perspective view of the combination fluid container-wiper unit of the present invention.

Referring to the drawings, and more particularly FIG. 1, there is shown a fluid dispensing-wiper device 10. Device 10 comprises container 11 which holds a fluid used for a particular cleaning operation, such as cleaning windows or mirrors. Container 11 is a conventional plastic unit having a threaded top for receiving dispensing means 12. Dispensing means 12, which is threaded onto container 11, includes an atomizer or fluid dispensing device having a plunger 13 which is a conventional reciprocating type that can be activated by depression of an operator's finger on head 14. The container 11 and fluid dispensing member 12 are conventional lightweight plastic devices which are readily available in the marketplace.

Figure 2:
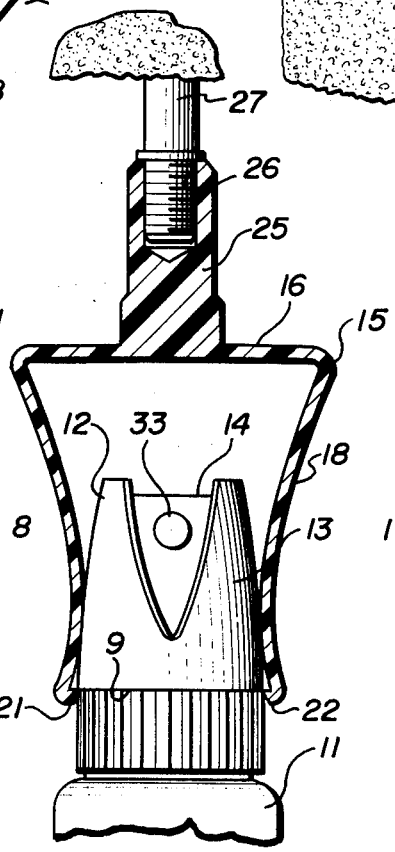
FIG. 2 shows a fragmentary section view of the bracket means, wiper head and dispensing means taken along lines 2—2 of FIG. 1.
Figure 4:
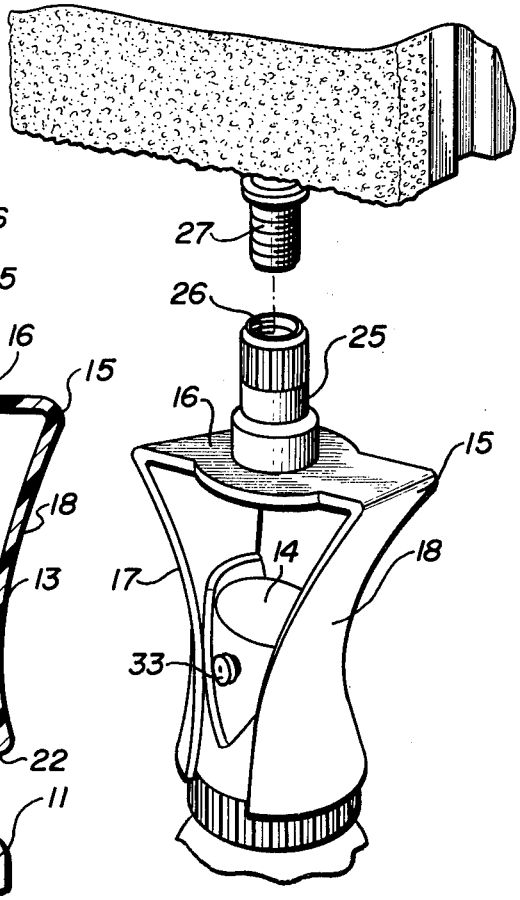

As shown in FIG. 2, dispensing unit 12 has an outer surface 8 which, when unit 12 is positioned on container 11, projects slightly outward to provide recess 9.

If desired, recess 9 could be placed in container 11 or dispensing unit 12 but the recess is generally conveniently formed when the container and dispensing unit are threadably fastened together.

Bracket member 15 is connected to container 11 and dispensing unit 12 at the location of recess 9. Bracket 15 includes base member 16 having two leg members 17, 18 which are spaced from each other. The leg members each have inwardly projecting lugs 21, 22 located at their respective free, outboard ends. The leg members are resilient and are normally inwardly biased. In assembly, leg members 17, 18 are pulled outward and positioned over dispensing unit 12 so that lugs 21, 22 are located in recess 9. Release of the spring biased leg members will allow them to move toward each other until they contact surface 8 of dispensing unit 12. Lugs 21, 22 are seated in recess 9 and bracket 15 is retained in substantially fixed position relative to dispensing unit 12.

An extension 25 projects from base 16 of bracket member 15. The extension is threaded at 26 and is adapted to receive the threaded projection 27 of wiper head 28.

Figure 3:
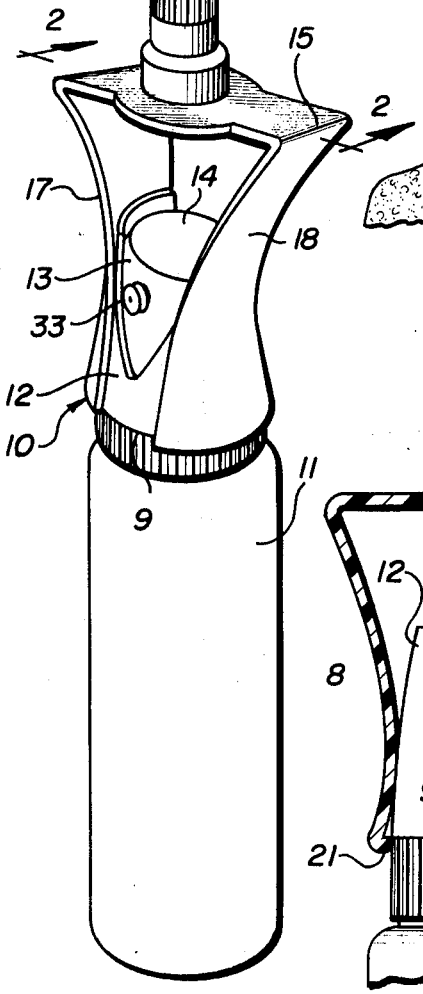
FIG. 3 shows a fragmentary section view of a wiper pad on the wiper head taken along lines 3—3 in FIG. 1; and, FIG. 4 shows a partial, perspective view of the removable wiper head removed from the bracket member of the present invention.

Wiper head 28 comprises a rectangular shaped backing member 29. Fluid absorbent pads 30, 31 are each connected to a face 36 of member 29. In FIG. 3, member 29 is shown flanged at its ends 33 and 34. Wiper pad 30 includes a sponge-like material glued or otherwise secured to plate 35. Each end of plate 35 forms a U-shape which is adapted to slide over the corresponding flanges of member 29. As illustrated more clearly in FIG. 1, pad 30 can be inserted onto head 28 by pushing the U-shape portions of plate 35 over the flanges 33 and 34 of wiper member 29. The fit between the flanges 33, 34 and the U-shaped end sections on pad 30 can be a friction fit or, if desired, other suitable fastening means, which would be obvious to one skilled in the art, can be utilized to fasten the pad to member 29. Accordingly, either individual pads 30, 31 can be replaced or, if desired, the entire wiper head 28 can be disconnected from extension 25.

In operation, fluid is placed in container 11. Dispensing means 12 are fastened to container 11 and subsequently legs 17, 18 are spread apart and disposed about unit 12 until lugs 21 and 22 are positioned in recess 14. When legs 17, 18 are released they will spring inwardly sufficient to lock bracket member 15 into position so that wiper head 28 is spaced above dispensing unit 12. Legs 17 and 18 seat against the outer surface 8 as seen more clearly in FIG. 2. Upon activation of dispensing unit 12, fluid is sprayed through fluid exit port 33 onto the object, e.g., window, to be cleaned. After spraying the object, the wiper pad, which can be made of any suitable sponge-like or other fluid absorbing material, is wiped against the object for final cleaning and drying.

When it is desired to use another pad, e.g., pad 31, bracket 15 can be rotated relative to dispensing unit 12 until pad 31 is in the position where pad 30 was previously located. Thus, when a cleaning operation occurs, it is not necessary to rotate the device 180° but rather the pad to be used for final cleaning and drying is already positioned above exit port 33 thereby allowing an operator to spray and wipe the object to be cleaned in one continuous operation without rotating unit 10.

While the materials of the present invention can be of any conventional materials, it is necessary to have the legs 17, 18 of a material which, while providing proper rigidity, will also be flexible enough to be pressed outwardly during assembly or disassembly of the device.

The foregoing description and drawings merely explain and illustrate the invention and the invention is not limited thereto, except insofar as the appended claims are so limited, as those who are skilled in the art who have the disclosure before them will be able to made modifications and variations without departing from the scope of the invention.

What is claimed is:

1. A fluid dispensing-wiper device for contacting and subsequently cleaning and drying an object, said device comprising:

a container for holding fluid;

means for dispensing fluid from said container onto an object, said dispensing means being removably connected to said container;

a single bracket means comprising a base and two resilient leg members depending from said base and biased toward each other;

said base being spaced above said dispensing means;

said resilient bracket leg members each including a lug means at the outboard end of said leg and said container and dispensing means having a recess formed therebetween to receive said lugs whereby said lugs are positioned in said recess and said bracket is retained in a biased position in said container solely by said leg members and lug means.

2. The fluid dispensing-wiper device of claim 1 wherein said wiper head includes means for detaching said wiper head from said bracket base.

3. A fluid dispensing wiper device for contacting and subsequently cleaning and drying an object, said device comprising:

a container for holding fluids;

means for dispensing fluid from said container onto an object, said dispensing means being removably connected to said container;

a single bracket means spaced above said dispensing means;

said bracket means consisting essentially of a base having two ends, two resilient leg members, each of said resilient leg members depending from an end of said base;

each leg member being normally biased toward said other leg member and each leg member having a lug means disposed at the outboard end of said leg, said lugs being adapted to be received in a recess formed between said container and dispensing means whereby said bracket will be retained in a biased position solely by said lug means and leg members.

4. The fluid dispensing-wiper device of claim 3 wherein said wiper head includes at least one face and a wiper pad is attached to said face.

5. The fluid dispensing-wiper device of claim 4 wherein said wiper pad is removably attached to said wiper face.

* * * * *